US007585200B1

(12) United States Patent
McLaren

(10) Patent No.: US 7,585,200 B1
(45) Date of Patent: Sep. 8, 2009

(54) POCKET BRA INSERT

(76) Inventor: Laura McLaren, 1801 Alabama St., Vallejo, CA (US) 94590

( * ) Notice: Subject to any disclaimer, the term of this patent is extended or adjusted under 35 U.S.C. 154(b) by 0 days.

(21) Appl. No.: 12/150,031

(22) Filed: Apr. 24, 2008

Related U.S. Application Data

(60) Provisional application No. 60/956,335, filed on Aug. 16, 2007.

(51) Int. Cl.
*A41C 3/00* (2006.01)

(52) U.S. Cl. ..... 450/89; 450/1; 2/247

(58) Field of Classification Search ..... 450/1, 450/36–38, 54–58, 89; 2/247–251, 104
See application file for complete search history.

(56) References Cited

U.S. PATENT DOCUMENTS

| | | | | |
|---|---|---|---|---|
| 173,698 | A * | 2/1876 | Weldon | 450/54 |
| 817,020 | A * | 4/1906 | Thompson | 450/54 |
| 1,984,253 | A * | 12/1934 | Cox | 604/346 |
| 4,899,395 | A | 2/1990 | Spector | 2/250 |
| 5,573,441 | A | 11/1996 | Smith | 450/89 |
| 6,318,613 | B1 | 11/2001 | Underhill | 224/587 |
| 6,461,221 | B1 * | 10/2002 | Stilwell et al. | 450/57 |
| 6,517,410 | B1 | 2/2003 | Underhill | 450/1 |
| 2006/0121826 | A1 | 6/2006 | Nazzaro | 450/89 |

* cited by examiner

*Primary Examiner*—Gloria Hale
(74) *Attorney, Agent, or Firm*—Deborah W. Wenocur

(57) ABSTRACT

A detachable holder for securing small objects inside a brassiere that:

can easily be inserted into and removed from a wide variety of brassieres;

is washable and follows the configuration of the bra;

secures the objects between a pocket in the holder and the bra cup;

does not add aesthetically unpleasing bulges;

and that can be constructed to be decorative or to further hold decorative additions.

18 Claims, 8 Drawing Sheets

POCKET BRA INSERT

CROSS REFERENCE TO RELATED APPLICATION

This application is related to U.S. Provisional Application No. 60/956,335, filed Aug. 16, 2007, and claims priority thereto. Application No. 60/956,335 is hereby incorporated by reference in its entirety.

FIELD OF THE INVENTION

This invention relates to wearable items for securing objects, and in particular to a brassiere insert with pockets for securing small items.

BACKGROUND OF THE INVENTION

In order to secure small valuable or essential items such as credit cards, money, or cell phones, women have often chosen to carry them in a place hidden from view, generally under some article of clothing. A particularly inaccessible (to a prospective thief) and secure place, and therefore one chosen by many women, is inside an undergarment such as a brassiere. There have been many holders designed to be attached or otherwise be secured to brassieres, and to hold small items. For example, U.S. Pat. No. 5,573,441, issued Nov. 12, 1996, and U.S. Pat. No. 6,318,613, issued Nov. 20, 2001 describe two different pouches, each of which is positioned in the center between the two cups of a bra and attached to the connecting region between the two cups. US Patent Publication No. US 2006/0121826, published Jun. 8, 2006, describes a brassiere incorporating a pouch, which may be detachable, either positioned on the side connecting region between the bra cups and the back fastener, or positioned on one of the over-the shoulder bra straps.

There are some disadvantages to the currently available designs. First of all, in most cases there is only one layer of security: if there is a malfunction or breach of the security pocket, there is nothing to stop the items enclosed from dropping or being lost. Secondly, aesthetically there is likely to be noticeable bulging since the pockets and the items secured within are generally positioned in places where the bra would not otherwise be. A safer, more discreet, and more aesthetic security pouch would be a useful improvement.

SUMMARY OF THE INVENTION

It is therefore an object of this invention to provide a detachable holder for securing small objects inside a brassiere.

It is a further object of this invention to provide a detachable holder for securing small objects inside a brassiere that can easily be inserted into and removed from a wide variety of brassieres.

It is a further object of this invention to provide a detachable holder for securing small objects inside a brassiere that is washable and follows the configuration of the bra.

It is a further object of this invention to provide a detachable holder for securing small objects inside a brassiere that secures the objects between a pocket in the holder and the bra cup.

It is a further object of this invention to provide a detachable holder for securing small objects inside a brassiere that does not add aesthetically unpleasing bulges and that can be constructed to be decorative or to further hold decorative additions.

These objects are met by the article described hereinafter.

DETAILED DESCRIPTION OF THE INVENTION

Figure 1A:
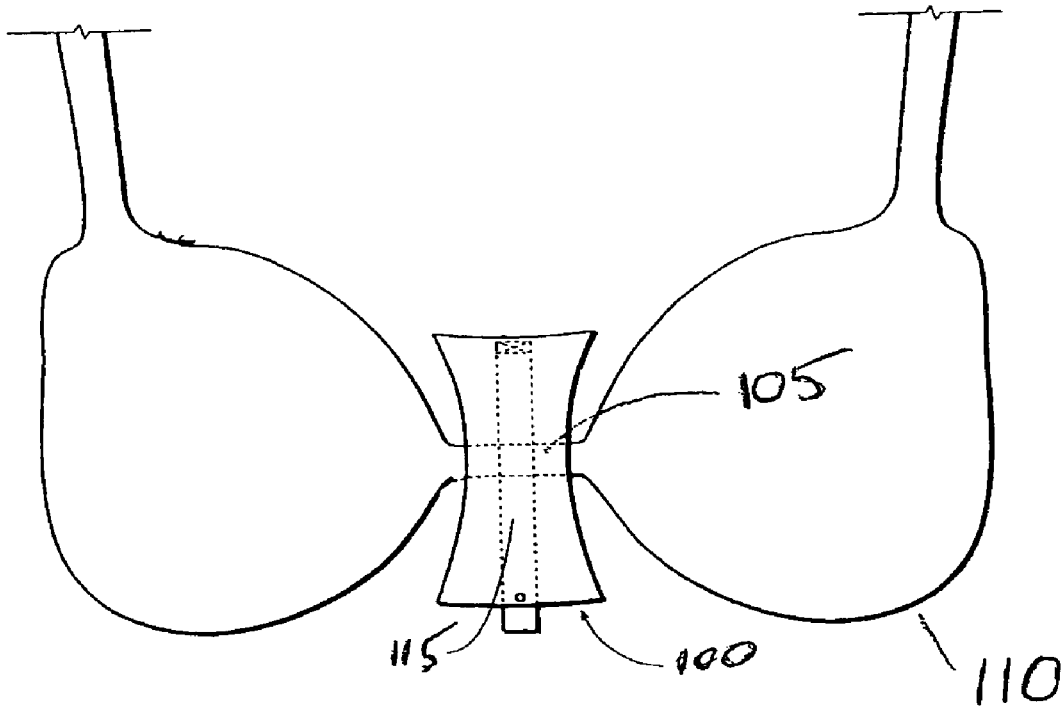
FIG. 1a PRIOR ART
FIG. 1*a* shows a first prior art security pouch attached to the center connecting region between two bra cups.
Figure 1B:
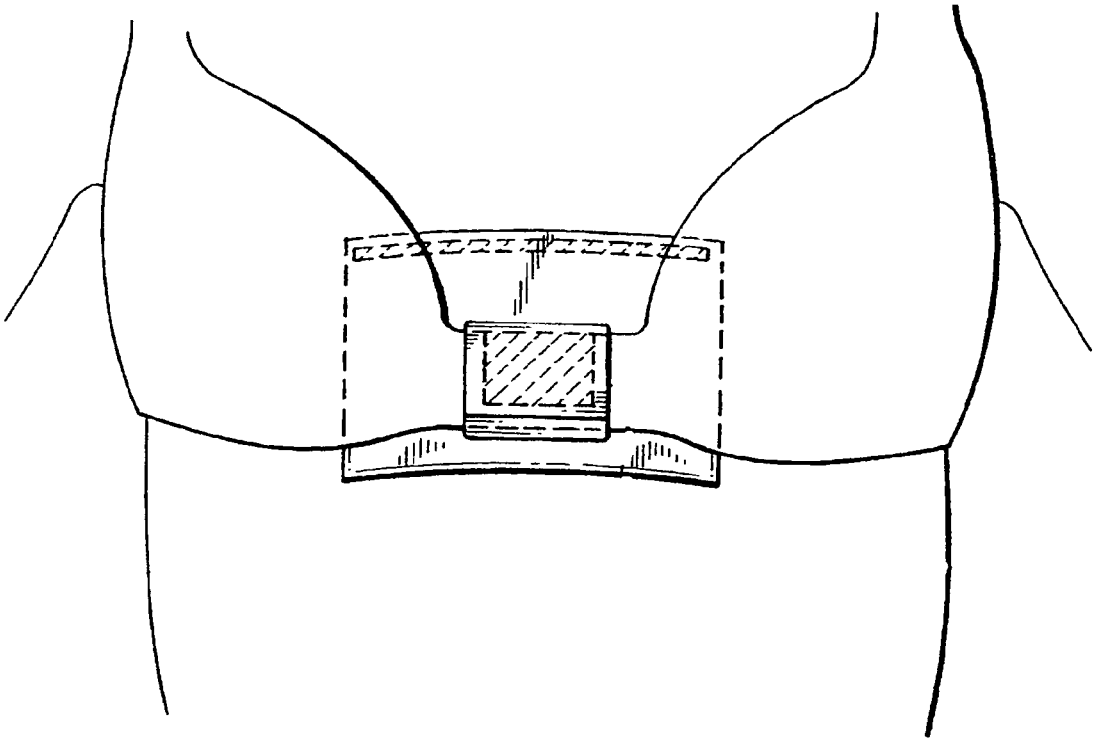
FIG 1b Prior art
FIG. 1*b* shows a second prior art security pouch attached to the center connecting region between two bra cups.

FIG. 1*a* shows a prior art security pouch, as described in U.S. Pat. No. 6,318,613, for attaching onto a brassiere. The security pouch 100 is worn between the front center 105 of a brassiere 110 or similar type of clothing and the wearer's skin. The pouch is held by wrap-around strap 115 that encircles center 105 of brassiere 110. This prior art pouch is worn on the outside of the bra center piece, and will therefore likely both cause bulging, and be subject to losing the secured items if there is a breach. Another prior art pouch, described in U.S. Pat. No. 5,573,441 and shown in FIG. 1*b*, is similarly positioned but is larger, is worn partially underneath the bra center piece, and extends slightly into the bra cup region. This design has the disadvantage of causing bulging and also of distorting the fit of the bra by pushing the bra center piece outward.

Figure 2:
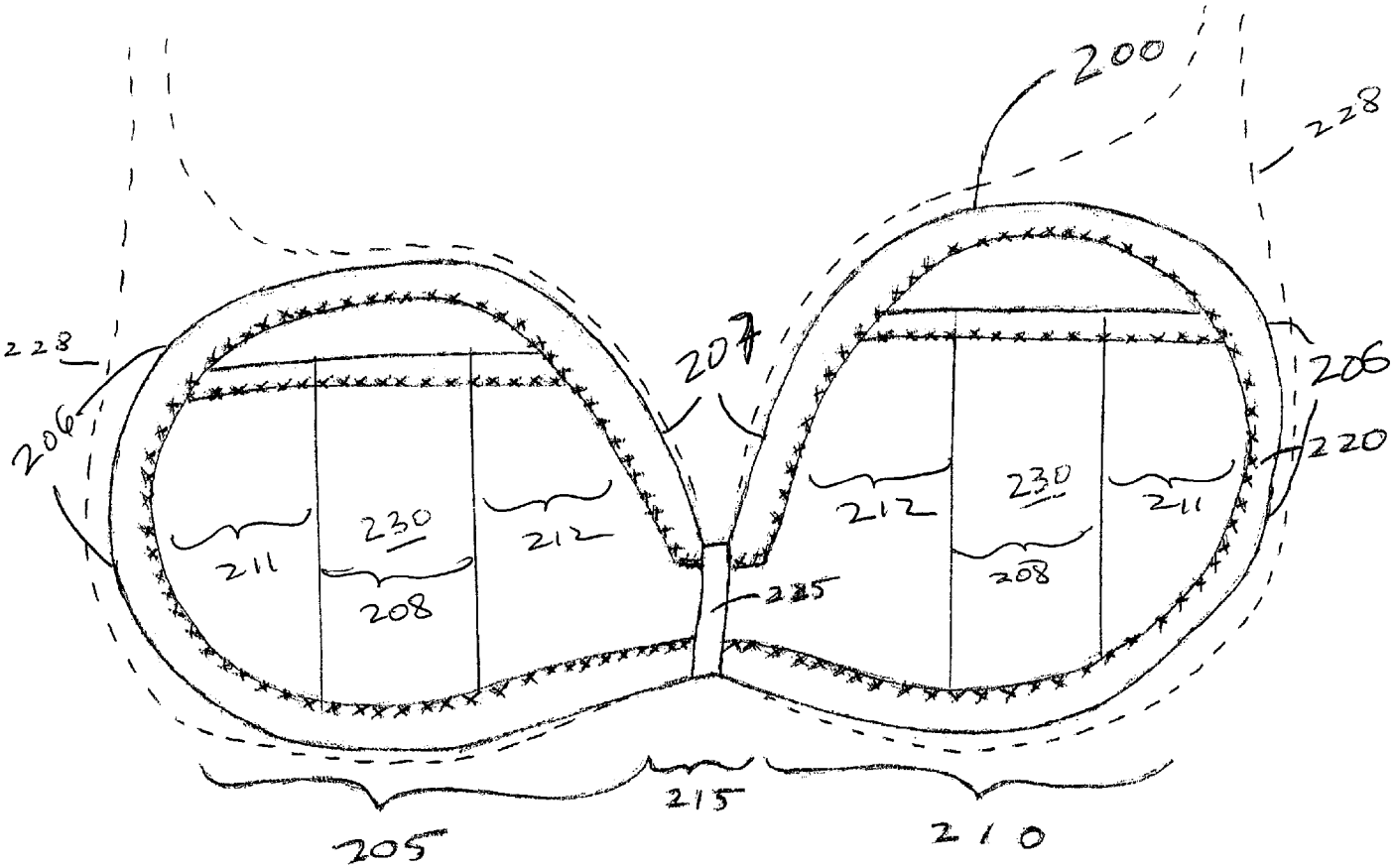
FIG. 2 illustrates a first embodiment of the pocket bra insert of the present invention, with the pocket at the center portion of the bra cup region.

FIG. 2 is an illustration of a first embodiment of the pocket bra insert of the present invention. Insert 200 has three regions: regions 205 and 210 are cup insert regions, and are connected by center region 215. The cup insert regions have side edges 206 and 207, center areas 208, and side areas 211 and 212. The insert is made of a washable cloth or cloth-like material, and may be quilted or padded for extra comfort. Possible materials used to construct the insert include but are not limited to: cotton, nylon tricot, single knits, double knits, micro fiber, woven blends, cotton blends, polyester blends, nylon blends, synthetic fiber or blends, rayon, flannel, wool, lace, linen, denim, twill, lycra, or a combination of any of the above. The entire insert is shaped to be similar to a standard brassiere shape, so that it may be inserted into most bras without noticeably distorting their shape, and without protruding substantially out of the areas already covered by the brassiere. Outer stitched region 220 provides enough rigidity to make insertion easy, but without adding uncomfortable stiffness. Fastener 225 which may be in the center is provided to attach insert 200 to the regular brassiere 228. In the embodiment shown, fastener 225 is an elastic strap with a snap to loop around the center region of the bra 228, but this is exemplary only. Other types or positions of fasteners could be employed, such as but not limited to: hook and loop fasteners such as Velcro brand, double sided tape, snaps, clamps, etc. Since the insert is pliable, a removable elastic could simply be looped around the bra and the insert. As will be seen hereinafter, such an elastic could also be used to attach a decorative item. Pockets 230 are, in this embodiment, located near the center of the bra cup region. "Pocket" as used in this application is defined as in the first two definitions in Dictionary.com:

1. a shaped piece of fabric attached inside or outside a garment and forming a pouch used esp. for carrying small articles.

2. a bag or pouch.

Accordingly, the terms "pocket" and "pouch" will be used interchangeably hereinafter. The pockets are sized appropriately to snugly fit such important items as credit cards or cell phones. In this embodiment the pocket is open at the top. The insert is positioned with the pocket side facing outward towards the bra. In this way, the secured items are pressed between the insert and the bra, which adds extra security should there be a breach in the pocket of the insert. The insert may be sized to more comfortably fit in different bra sizes, e.g., sized as S, M, L.

Figure 3:
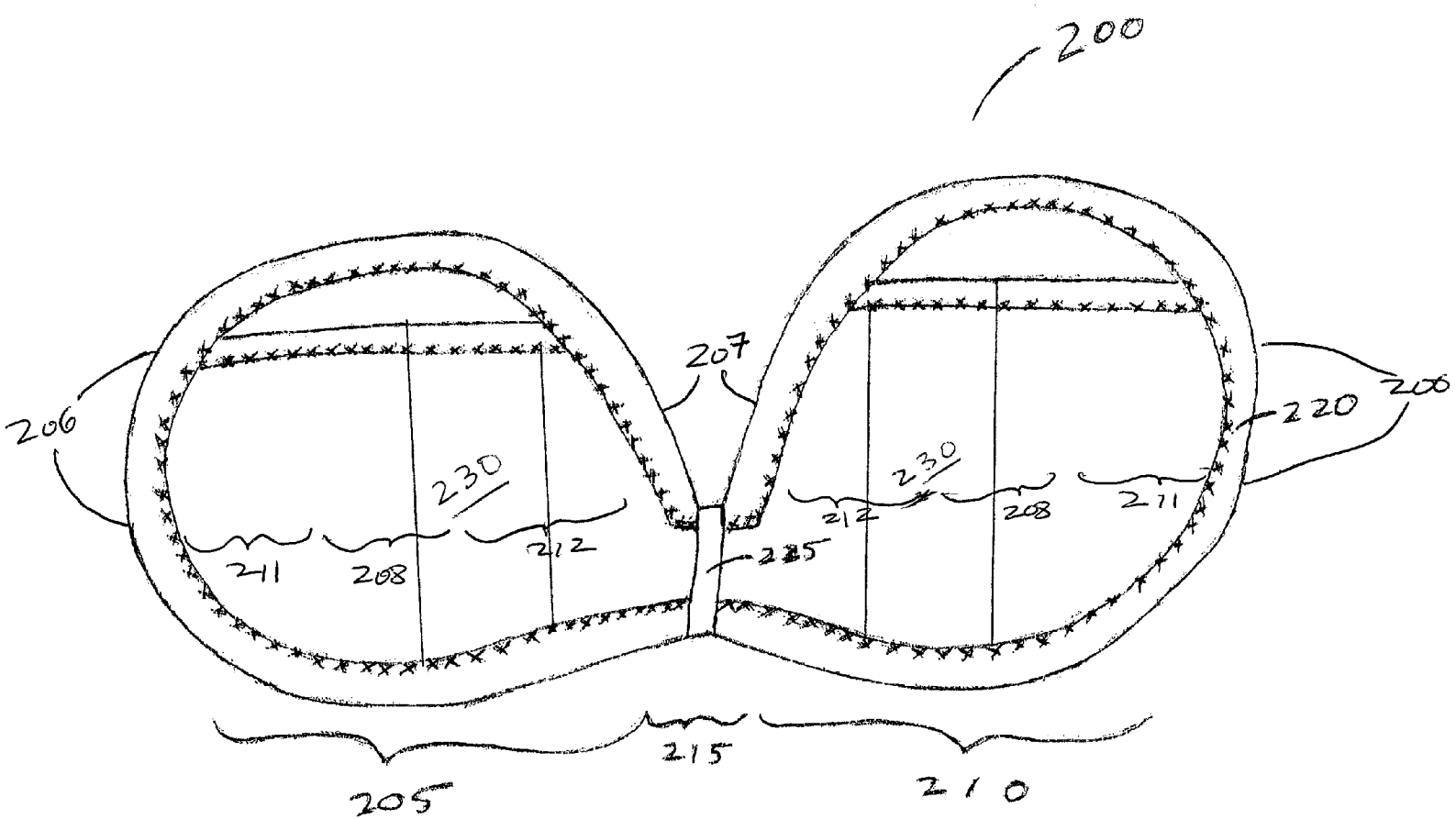
FIG. 3 illustrates a second embodiment of the pocket bra insert of the present invention, with the pocket at a side portion of the bra cup region.

FIG. 3 illustrates a second embodiment of the pocket bra insert of the present invention. In this embodiment pockets 230 are located near the sides of the bra cup region. Sub-embodiments may have the pockets near the inner sides or the outer sides of the bra cup region. This second embodiment may provide added comfort for women with particularly sensitive central or nipple regions. It may also cause less bulging, particularly for flat items such as credit cards which would fit more compactly onto the flat side areas of the bra cup rather than onto the curved central region.

Figure 4:
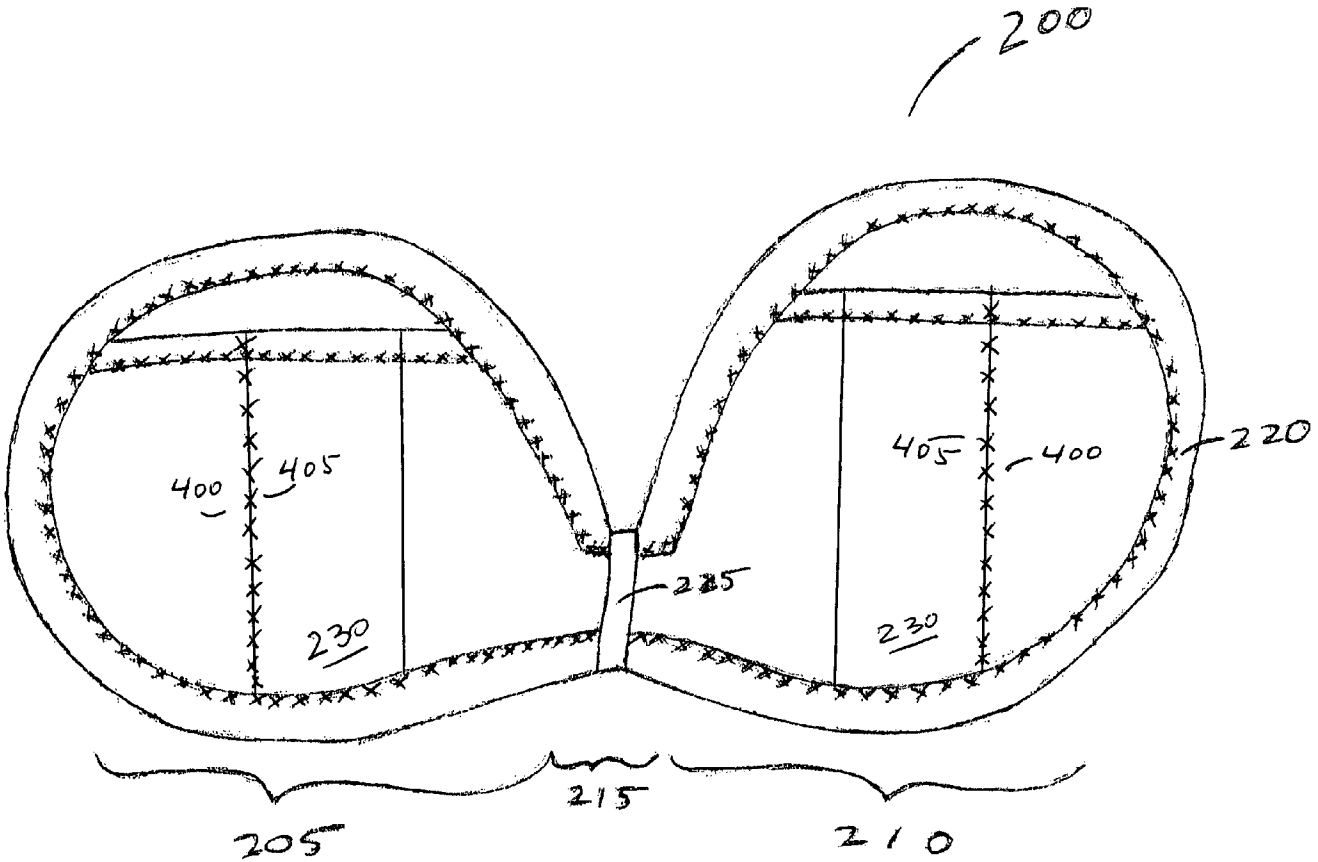
FIG. 4 illustrates a third embodiment of the pocket bra insert of the present invention, with a side zipper on the pocket.

FIG. 4 illustrates a third embodiment of the pocket bra insert of the present invention. In this embodiment the pocket has a re-usable closure at one edge, rather than being open at the top. Illustrated is a pocket with a zipper 400 closing side 405. Other types and positions of closures are possible, for example: Velcro; snap; tape; hook; a flap with or without a button, which may be placed at the top of the pocket rather than at the side.

Figure 5:
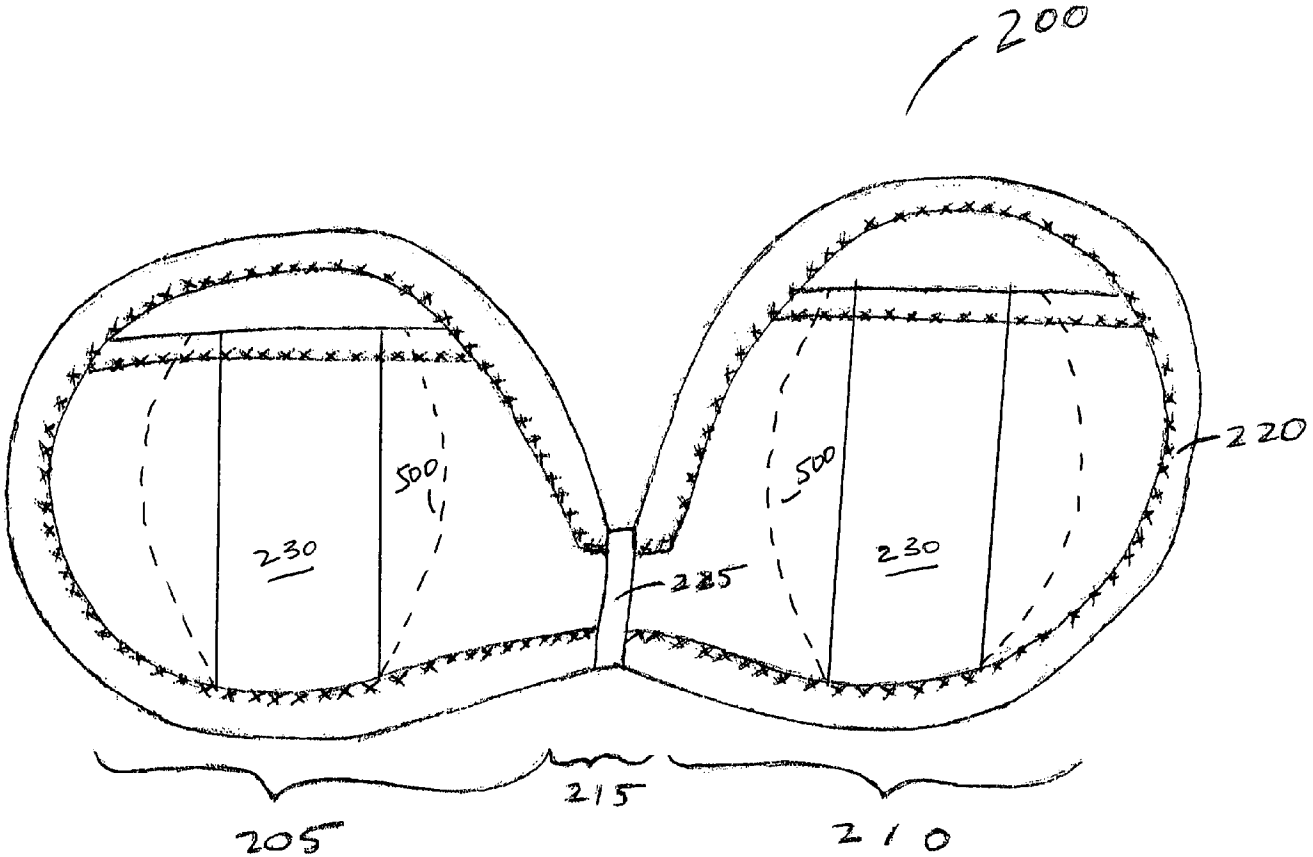
FIG. 5 illustrates a fourth embodiment of the pocket bra insert of the present invention, with an additional pocket in the interior of the insert.

FIG. 5 illustrates a fourth embodiment of the pocket bra insert of the present invention, which further includes interior pocket or pockets 500 disposed on the interior surface of the insert, to be worn facing the person's skin. This interior pocket could be used to hold additional valuables, or alternatively it could be used, for example, to hold padding or other breast enhancements.

Figure 6A:
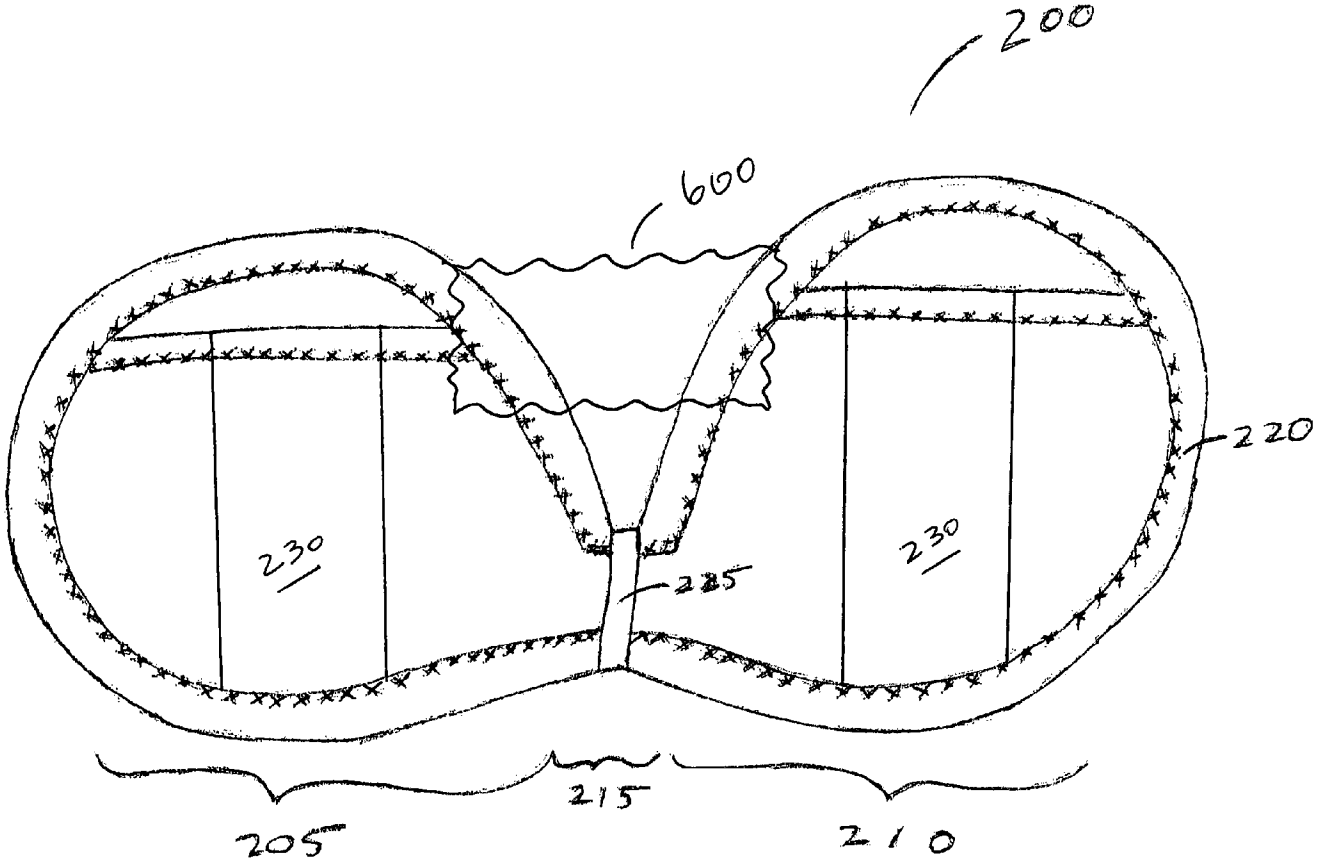
FIG. 6*a* illustrates a fifth embodiment of the pocket bra insert of the present invention, with a decorative panel added.

FIG. 6*a* illustrates a fifth embodiment of the pocket bra insert of the present invention, which adds a decorative panel 600 across the center region. This panel can extend upward so as to be visible on the outside of a low necklined article of outer clothing, thereby adding modesty as well as decoration. The decorative panel can be lace, by way of example, or other decorative fabric. The decoration could also be extended across the entire top of the insert.

Figure 6B:
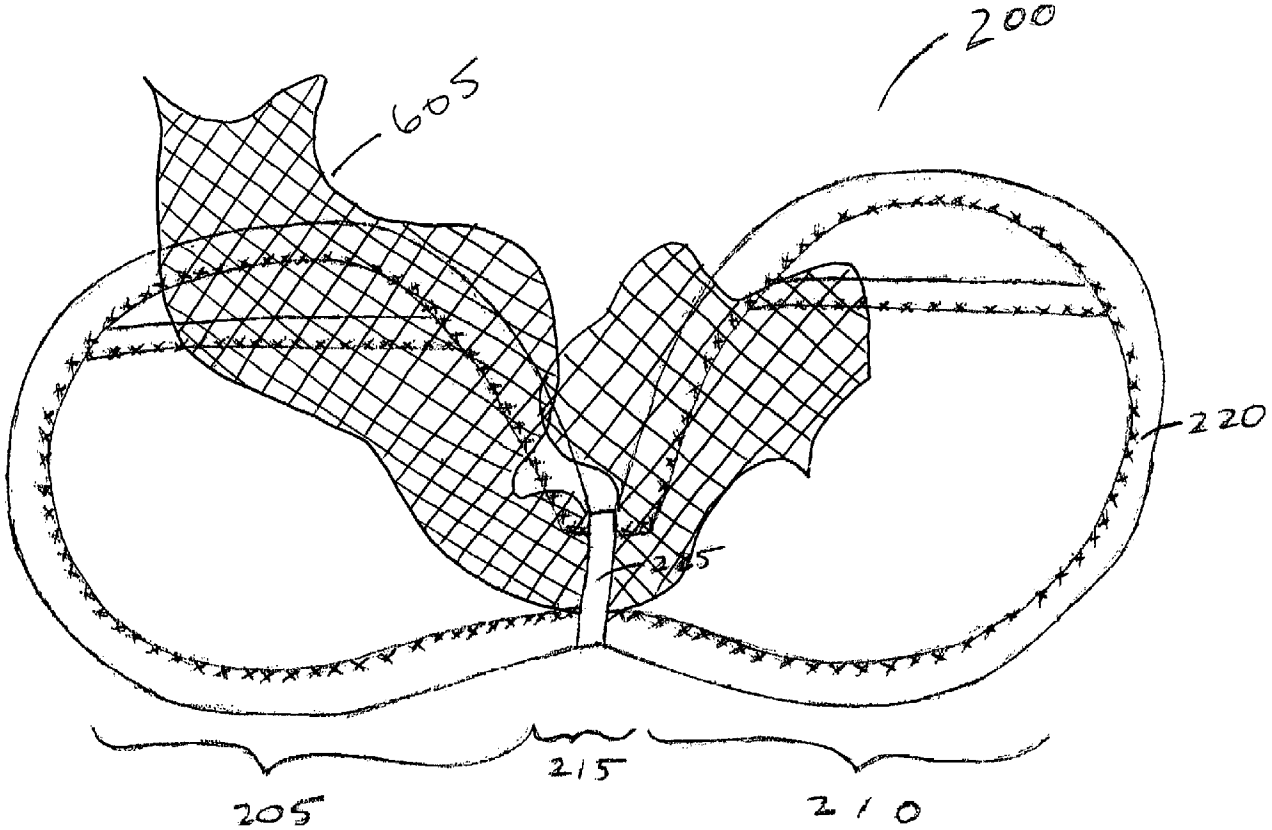
FIG. 6*b* illustrates a sixth embodiment of the pocket bra insert of the present invention, with a decorative accessory attached.

FIG. 6*b* illustrates a sixth embodiment of the pocket bra insert of the present invention, with a decorative accessory 605 attached. This accessory may be, for example, a scarf, which can both add aesthetic value, and can also serve to cover cleavage visible with low-cut outer garments. The accessory may be attached, for example, with a Velcro strip, or by inserting a scarf through the elastic loop attaching the insert to the bra.

In summary, the pocket bra insert of the present invention adds functionality and aesthetic value that is not present in currently available security holders for using with brassieres. It is detachable, washable, easily inserted and secured to a wide variety of brassieres, adds safety to the secured objects by placing them between the insert and the bra cup, is comfortable to wear and does not cause unsightly bulging or deforming of the bra fit, and can be adapted to add decoration and provide modesty.

It is not expected that the present invention be limited to the exact embodiments disclosed herein. Changes and modifications can be made without departing from the inventive concept. For example, the exact method of connecting the insert to the bra may differ from those disclosed. The scope of the invention should be construed in view of the claims.

With this in mind, I claim:

1. A detachable pocket bra insert for inserting into the cup portion of a brassiere to be held between said brassiere and the skin of a person wearing said brassiere, comprising:

two cup insert regions, each said cup insert region being similarly shaped to a brassiere cup and fitting into said brassiere cup;

a center region connecting said two cup insert regions;

each said cup insert region having a first side edge adjacent said center region and a second side edge opposite said center region, a center area, a first side area between said center area and said first side edge, and a second side area between said center area and said second side edge;

at least one pocket/pouch in a cup insert region; and means for attaching said insert to said brassiere;

for securely holding small items in said at least one pocket.

2. The detachable pocket bra insert of claim 1, wherein said at least one pocket/pouch is disposed to face said brassiere, for securely holding small items in said at least one pocket, between said insert and said brassiere cup.

3. The pocket bra insert of claim 1, wherein said insert is washable, comprised of a pliable fabric material suitable for wearing directly next to the skin, and wherein said insert is constructed to hold its shape sufficiently to be easily inserted into said brassiere.

4. The pocket bra insert of claim 1, wherein said at least one pocket/pouch is located in said center area of said cup insert region.

5. The pocket bra insert of claim 1, wherein said at least one pocket/pouch is located near said first side area of said cup insert region.

6. The pocket bra insert of claim 1, wherein said at least one pocket/pouch is located near said second side area of said cup insert region.

7. The pocket bra insert of claim 2, further including at least one inside pocket/pouch in a cup insert region, disposed to face inwardly toward the skin of the person wearing said brassiere.

8. The pocket bra insert of claim 7, wherein said at least one inside pocket/pouch is configured to receive and contain a breast enhancement insert.

9. The pocket bra insert of claim 1, wherein said pocket/pouch has a re-usable closure at one edge.

10. The pocket bra insert of claim 9, wherein said re-usable closure is selected from the group consisting of: zipper, hook and loop, button, flap, snap, hook, tape.

11. The pocket bra insert of claim 10, wherein said re-usable closure is a side zipper.

12. The pocket bra insert of claim 1, wherein said means for attaching said insert to said brassiere is chosen from the group consisting of: an elastic; hook and loop; tape; snap; hook; button, and a clamp.

13. The pocket bra insert of claim 12, wherein said means for attaching said insert to said brassiere comprises an elastic strap configured to snap around a center region of said brassiere.

14. The pocket bra insert of claim 12, wherein said means for attaching said insert to said brassiere comprises an elastic loop for looping around the center region of said brassiere and the center region connecting said two cup insert regions.

15. The pocket bra insert of claim 1, further including a decorative panel across said center region connecting said two cup insert regions.

16. The pocket bra insert of claim 1, further including means for attaching a decorative accessory thereto.

17. The pocket bra insert of claim 16, wherein said means for attaching a decorative accessory thereto comprises an elastic loop looped around the center region connecting said two cup insert regions for inserting a scarf thereinto.

18. The pocket bra insert of claim 16, wherein said means for attaching a decorative accessory thereto comprises Velero hook and loop.

* * * * *